US005889360A

United States Patent [19]

Frey et al.

[11] Patent Number: 5,889,360

[45] Date of Patent: Mar. 30, 1999

[54] DISCHARGE LAMP WITH CAPACITIVE SOCKET

[75] Inventors: Martin Frey, Lichtenstein; Thomas Fabry, Neckartenzlingen, both of Germany

[73] Assignee: Robert Bosch GmbH, Stuttgart, Germany

[21] Appl. No.: 860,352

[22] PCT Filed: Sep. 11, 1996

[86] PCT No.: PCT/DE96/01703

§ 371 Date: Jun. 4, 1997

§ 102(e) Date: Jun. 4, 1997

[87] PCT Pub. No.: WO97/15064

PCT Pub. Date: Apr. 24, 1997

[30] Foreign Application Priority Data

Oct. 13, 1995 [DE] Germany ..... 195 38 064.9

[51] Int. Cl.[6] ..... H01J 7/44; H01J 17/34

[52] U.S. Cl. ..... 313/318.01; 313/318.01; 315/59; 362/265

[58] Field of Search ..... 313/318.01, 318.02, 313/318.08, 318.11; 315/58, 59, 53, 227 R, 241 R; 439/620; 362/265

[56] References Cited

U.S. PATENT DOCUMENTS 4,134,042 1/1979 Van Heemskerck Veeckens ..... 315/59
5,039,904 8/1991 Kosmatka et al. ..... 313/318.11
5,389,856 2/1995 Loijks et al. ..... 315/58
5,434,763 7/1995 Hege et al. ..... 362/265

FOREIGN PATENT DOCUMENTS 36 03 743 A1 8/1987 Germany ..... H01J 61/82
43 10 307 A1 10/1994 Germany ..... H05B 41/29

*Primary Examiner*—Sandra O'Shea
*Assistant Examiner*—Michael Day
*Attorney, Agent, or Firm*—Michael J. Striker

[57] ABSTRACT

The discharge lamp has a discharge vessel (10) and a socket (20) made of an electrically insulating material. Two electrodes (12, 13) project into the discharge vessel (10), with which electrical lines (16,17) are connected, which are conducted through the socket (20). A first electrically conductive component (22) is connected with the one line (16), and a second electrically conductive component (26) is connected with the other line (17), surrounds the first component (22) and is separated from it by the insulating material of the socket (20). The two components (22, 26), together with the insulating material of the socket (20), constitute a capacitive component, which is switched in parallel between the two lines (16,17), thus preventing or at least reducing the spreading of electromagnetic interference along the lines (16,17).

9 Claims, 1 Drawing Sheet

DISCHARGE LAMP WITH CAPACITIVE SOCKET

BACKGROUND OF THE INVENTION

The invention relates to a discharge lamp, in particular for vehicle lighting systems.

Such a discharge lamp is known from DE 36 03 743 A1. This discharge lamp has a discharge vessel with two electrodes arranged inside. In addition, the discharge lamp has a socket made of electrically insulating material, through which electrical lines are conducted to the electrodes. Discharge lamps are commonly operated at high voltage and it has been shown that electromagnetic interference along the electrical lines to the lamp tends to occur during operation. In DE 43 10 307 it is suggested to place a filter circuit into a housing near the discharge lamp in order to prevent or at least reduce the spreading of electromagnetic interference. The filter circuit has a condenser among other things, which is connected in parallel with the electrical lines to the discharge lamp. However, this additional filter circuit represents a large expenditure and creates additional costs.

ADVANTAGES OF THE INVENTION

In contrast thereto, the discharge lamp in accordance with the invention has the advantage that with the addition of a few components a capacitively acting component is integrated into the socket of the discharge lamp, by means of which the spreading of electromagnetic interference via the electrical lines to the lamp is prevented or at least reduced.

BRIEF DESCRIPTION OF THE DRAWINGS

An exemplary embodiment of the invention is shown in the drawings and is more closely explained in the following description.

DESCRIPTION OF THE PREFERRED EMBODIMENT

Figure 1:
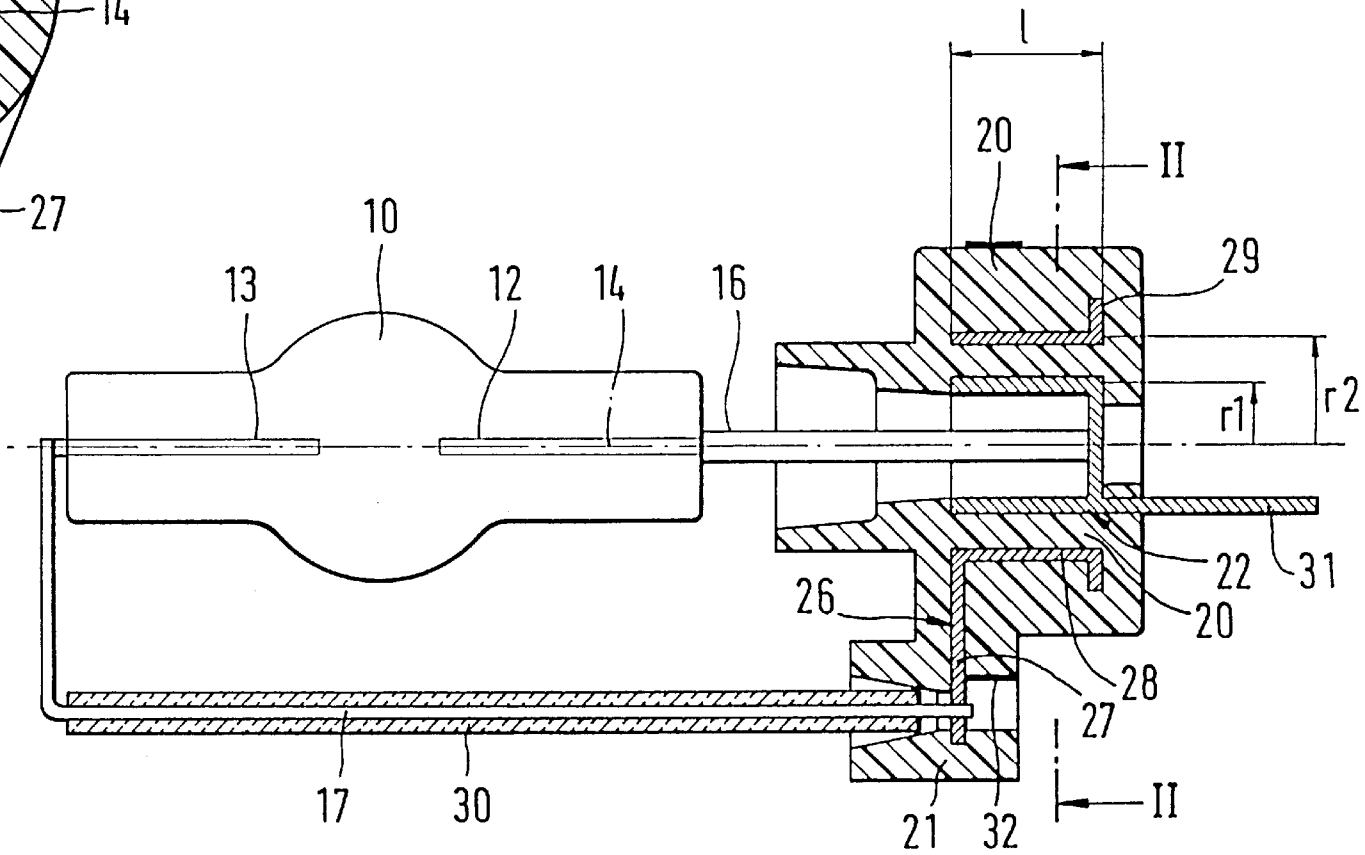
FIG. 1 shows a discharge lamp in cross-section.
Figure 2:
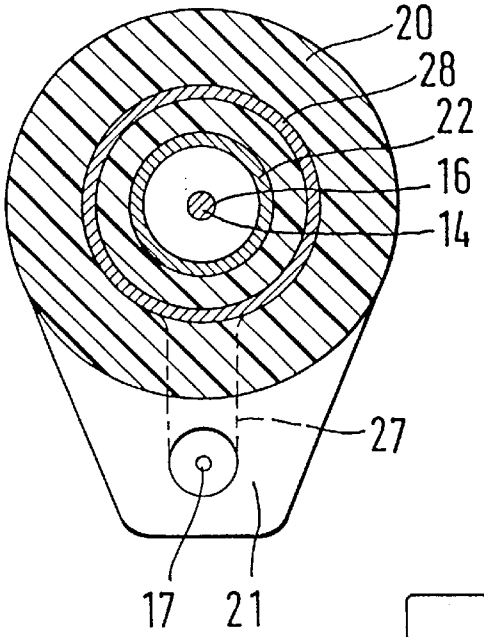
FIG. 2 shows the discharge lamp in cross-section along line II—II in FIG. 1.

A discharge lamp for vehicle lighting systems, in particular for motor vehicle head lights as shown in FIGS. 1 and 2, has a discharge vessel 10 with two inward extending electrodes 12 and 13. In the exemplary embodiment shown, the electrodes 12, 13 are arranged opposite each other in the direction of the longitudinal axis 14 of the lamp. However, it is also possible to arrange the electrodes in such a way that they are situated opposite each other transversely to the longitudinal axis 14 of the lamp. The discharge vessel 10 contains a mixture of different substances which, when a voltage is applied between the electrodes 12, 13, are excited to output light. Preferably the discharge vessel 10 contains mercury under high pressure and, if desired, a metal halide, or a mixture of different metal halides. In addition, the discharge vessel can contain a rare gas, for example xenon.

An electrical line 16 or 17 which leads to a socket 20 of the discharge lamp is connected to each electrode 12, 13. The line 16 connected to the electrode 12 leading to the socket 20 is disposed approximately centrally in respect to the discharge vessel 10 and approximately parallel with the longitudinal axis 14 of the lamp, and the line 17 connected to the other electrode 13 is disposed off center and approximately parallel with the longitudinal axis 14 of the lamp. The socket 20 of the discharge lamp is made of an electrically insulating material, for example a plastic or ceramic material. A component 22 made of an electrically conductive material is connected with the end of the line 16 arranged in the socket 20, which for example is embodied as a sleeve which is round at least on its exterior, and which is disposed coaxially with the longitudinal axis 14 of the lamp. The component 22 is enveloped by the insulating material of the socket 20, at least at its exterior circumference. In the direction of the longitudinal axis 14, the component 22 has a length 1 and a radius of rl in relation to the longitudinal axis 14.

A component 26 made of an electrically conductive material is also connected with the end of the other line 17 arranged in the socket 20. The socket 20 has a widening 21 in which the end of the line 17 has been placed. The component 26 is essentially embodied in a ring shape and has a connecting piece 27, by which it is connected to the end of the line 17, and a ring-shaped section 28, which envelops the component 22. The ring-shaped section 28 of the component 26 is preferably disposed coaxially with the component 22 and thus with the longitudinal axis 14, so that the distance between the exterior circumference of the component 22 and the interior circumference of the section 28 is constant. Viewed in the direction of the longitudinal axis 14 of the lamp, the ring-shaped section 28 of the component 26 is disposed in the same area as the component 22 and preferably extends over the same length 1 as the component 22. Thus, viewed in the direction of the longitudinal axis 14 of the lamp, the ring-shaped section 28 of the component 26 is disposed at least almost congruently with the component 22. The ring-shaped section 28 of the component 26 is disposed on a radius r2 around the longitudinal axis 14, and embodied to be closed over its entire circumference, but can also be designed with breaks. At its end pointing away from the discharge vessel 10, the ring shaped section 28 of the component 26 has an edge 29 projecting radially outward in respect to the longitudinal axis 14. The component 26 is almost completely enveloped by the insulating material of the socket 20. In its area disposed outside the socket 20 in the direction toward the electrode 13, the line 17 can be provided with an electrically insulating sheath 30.

The components 22 and 26 are preferably made of metal, for example copper, and are electrically separated from each other by the insulating material of the socket 20 between them. During the operation of the discharge lamp, the components 22 and 26 generate a capacitive effect by means of the insulating material of the socket 20 and form a capacitive component, which is connected in parallel between the two lines 16 and 17. The capacitance C of this component can be determined in accordance with the following equation:

$$C = \frac{2 \cdot \pi \cdot \epsilon_0 \cdot \epsilon_r \cdot 1}{\ln(r2/r1)}$$

Wherein:

$\epsilon_r$ is the dielectric constant of the insulating material of the socket, $\epsilon_0$ is the electrical field constant, which is 8.854 10–12 F/m, r1 is the radius of the interior component 22, r2 is the radius of the ring shaped section 28 of the exterior 26, l is the length of components 22, 28.

By respective variations of the measurement l and/or r1 and/or r2, a capacitive component of preset capacitance can be formed. Particularly through variation of the length 1, the capacitance can easily be changed. Usable materials for the socket 20 of the discharge lamp can for example be polyether imide, PEI, which has a dielectric constant $\epsilon_r$ of approximately 3.5. At values r1=4 mm and r2=5.2 mm, a capacitance of approximately 5.9 pF results with the length 1 being 8 mm, with the length 1 being 10 mm, a capacitance of 7.4 pF will result, with the length 1 being 12 mm, a capacitance of 8.9 will result. Another usable material for the socket 20 can also be polyphenylene sulfide, PPS.

Connecting elements arranged on the side of the socket 20 which is opposite from the discharge vessel 10 are connected with the lines 16, 17. For example, a plug sleeve 31 or a pin plug can be connected with the centrally located line 16, and a conductor ring 32 with the off center line 17. A plug component, not shown, which has corresponding counter connecting elements, can be attached on the socket 20 of the discharge lamp.

The socket 20 of the discharge lamp is preferably produced by injection molding, wherein the components 22, 26 are placed in predetermined order to each other into an injection mold, and are covered with the electrically insulating plastic material of the socket.

In place of the aforementioned ring-shaped embodiment of components 22 and 26, a plate-shaped embodiment of these components is also possible. In this case a plate-shaped electrical conductive component is also connected with each line 16, 17, wherein the two components are separated from each other by the insulating material of the socket 20 and form a plate capacitor.

We claim:

1. A discharge lamp for vehicle lighting systems, comprising a discharge vessel; at least two electrodes extending into said discharge vessel; a socket composed of an electric insulating material; electrical lines conducted to said electrodes through said socket; at least two components composed of electrically conductive material and disposed in said socket, said components being connected with said electrical lines, said components assigned to said electrical lines being electrically separated from each other by said insulating material of said socket, and together with said insulating material of said socket constituting a capacitive component.

2. A discharge lamp as defined in claim 1, wherein said socket is composed of plastic.

3. A discharge lamp as defined in claim 2, wherein said socket is composed of polyetherimide.

4. A discharge lamp as defined in claim 2, wherein said socket is composed of polyphenylene sulfide.

5. A discharge lamp for vehicle lighting systems, comprising a discharge vessel; at least two electrodes extending into said discharge vessel; a socket composed of an electric insulating material; electrical lines conducted to said electrodes through said socket; at least two components composed of electrically conductive material and disposed in said socket, said components being connected with said electrical lines, said components assigned to said electrical lines being electrically separated from each other by said insulating material of said socket, and together with said insulating material of said socket constituting a capacitive component, a first one of said components being connected with one of said lines and having a somewhat cylindrically shaped exterior, a second one of said components being connected with another of said lines and having an approximately ring-shaped section which surrounds said first component at a distance.

6. A discharge lamp as defined in claim 5, wherein said first component and said ring-shaped section of said second component are disposed at least coaxially.

7. A discharge lamp as defined in claim 5, wherein one of said electrodes and one of said lines connected with said one electrode are arranged approximately centrally in respect to a longitudinal axis of the lamp, said first component being connected with said one line, another of said electrodes and another of said lines connected with another of said electrodes being arranged off center in respect to the longitudinal axis of the lamp, said second component being connected with said another line.

8. A discharge lamp as defined in claim 5, wherein said components are arranged at least approximately congruently in a direction of a longitudinal axis of the lamp.

9. A discharge lamp for vehicle lighting systems, comprising a discharge vessel; at least two electrodes extending into said discharge vessel; a socket composed of an electric insulating material; electrical lines conducted to said electrodes through said socket; at least two components composed of electrically conductive material and disposed in said socket, said components being connected with said electrical lines, said components assigned to said electrical lines being at least partially enveloped by said insulating material of said socket and electrically separated from each other by said insulating material of said socket, and together with said insulating material of said socket constituting a capacitive component which prevents or at least reduces a spreading of electromagnetic interference via said electrical lines to the lamp.

* * * * *